US007021558B2

(12) United States Patent
Chenanda et al.

(10) Patent No.: US 7,021,558 B2
(45) Date of Patent: Apr. 4, 2006

(54) FUEL INJECTOR HAVING A COOLED LOWER NOZZLE BODY

(75) Inventors: Cariappa M. Chenanda, Columbus, IN (US); David L. Buchanan, Westport, IN (US); Lester L. Peters, Columbus, IN (US)

(73) Assignee: Cummins Inc., Columbus, IN (US)

( * ) Notice: Subject to any disclaimer, the term of this patent is extended or adjusted under 35 U.S.C. 154(b) by 184 days.

(21) Appl. No.: 10/423,010

(22) Filed: Apr. 25, 2003

(65) Prior Publication Data

US 2004/0211846 A1 Oct. 28, 2004

(51) Int. Cl.
*B05B 9/00* (2006.01)

(52) U.S. Cl. ..... 239/125; 239/132; 239/132.3; 239/132.5; 239/88; 239/96; 239/585.1; 239/584

(58) Field of Classification Search ..... 239/88–94, 239/585.1–585.5, 533.2–533, 124, 125, 128, 239/132, 132.1, 132.3, 132.5, 584; 251/129.21, 251/129.15, 129.16
See application file for complete search history.

(56) References Cited

U.S. PATENT DOCUMENTS

| | | | | |
|---|---|---|---|---|
| 2,959,360 | A * | 11/1960 | Nichols | 239/96 |
| 3,612,012 | A | 10/1971 | Dreisin | |
| 3,958,757 | A * | 5/1976 | Happel et al. | 239/125 |
| 4,394,964 | A * | 7/1983 | Ecomard et al. | 239/90 |
| 4,717,080 | A * | 1/1988 | Sauer | 239/125 |
| 4,986,472 | A | 1/1991 | Warlick et al. | |
| 5,042,721 | A | 8/1991 | Muntean et al. | |
| 5,076,236 | A | 12/1991 | Yu et al. | |
| 5,325,838 | A | 7/1994 | Bennett | |
| 5,419,492 | A * | 5/1995 | Gant et al. | 239/88 |
| 5,441,027 | A | 8/1995 | Buchanon et al. | |
| 5,647,536 | A | 7/1997 | Yen et al. | |
| 5,765,755 | A | 6/1998 | Peters et al. | |
| 5,860,394 | A | 1/1999 | Saito et al. | |
| 5,899,385 | A | 5/1999 | Hofmann et al. | |
| 6,499,467 | B1 | 12/2002 | Morris et al. | |

FOREIGN PATENT DOCUMENTS

| | | |
|---|---|---|
| AU | 204195 | 3/1955 |
| DE | 200330 | 4/1983 |

* cited by examiner

*Primary Examiner*—Steven J. Ganey

(57) ABSTRACT

A fuel injector is provided with a lower nozzle body which is cooled with a small amount of metered fuel. In one embodiment, a blind passage is formed to extend from the upper portion to the lower end of the injector nozzle valve element. A transverse passage is formed in the nozzle valve element connecting the blind passage and the nozzle bore. Rail pressure causes a metered amount of fuel to flow through the nozzle bore, the transverse passage and upwardly along the blind passage to the drain passage. Inward cooling occurs by providing more surface area over which the fuel flows. In another embodiment, a sleeve is formed to fit over an existing nozzle to form a passage surrounding the injector tip. An orifice is located in the nozzle housing to connect the nozzle cavity with the annular passage thereby providing a small amount of fuel to drain.

22 Claims, 4 Drawing Sheets

FUEL INJECTOR HAVING A COOLED LOWER NOZZLE BODY

BACKGROUND OF THE INVENTION

1. Field of the Invention

The present invention relates to a fuel injector having a cooled lower nozzle body, and more particularly to a cooled lower nozzle body of a common rail, needle controlled injector arranged to provide for a small amount of cooling medium (fuel) to flow through the nozzle of the injector to cool the same.

2. Description of Related Art

Fuel injectors have been commonly used with internal combustion engines such as diesel engines to deliver combustible fuel to the combustion chambers within the cylinders of the engine. Various injector designs have been implemented in the art but most fuel injectors have a nozzle with a valve element movably disposed therein in which when opened, provides a spray of fuel into the combustion chamber of the cylinder. In this regard, fuel injectors typically include a nozzle including an outer barrel, a retainer, and a nozzle housing that houses the valve element of the fuel injector. The fuel injector is typically mounted to an injector bore in the cylinder head of the internal combustion engine and the nozzle housing having an injection hole generally extends at least partially into the combustion chamber so that fuel may be provided therethrough. In this regard, the retainer is received within the injector bores of the cylinder head and includes an opening proximate to the combustion chamber of the cylinder which allows the nozzle housing to extend into the combustion chamber. Such nozzle designs are generally illustrated in U.S. Pat. No. 5,441,027 to Buchanan et al.

The lower section of the nozzle outer body of an injector, or injector tip, is generally exposed to high temperatures in the combustion chamber of the cylinder during combustion. It is not uncommon for flame temperatures in the cylinder to exceed 4000° F. In such situations, the nozzle outer body can experience service temperatures in excess of its tempering temperature, for example 450° F.

In the process of normal diesel fuel injection, the fuel itself, which is in a pressurized state located in an annular cavity around the needle, serves as the media which cools the injector and the tip of the nozzle shank as the pressurized fuel is sprayed from the injector hole. However, recently there has been a tremendous push to increase fuel efficiencies and reduce emissions in internal combustion engines, and in particular, in diesel engines. In a quest to attain these goals in which the injectors and the fuel systems operation must be optimized, engineers have utilized fuel injectors which provide reduced injection flows such as in pilot injection, pre-injection, and/or through the use of a second injector. In many such applications, the quantity of fuel injected is relatively small i.e., less than 5 mm3/stroke. The cooling provided by such small quantities of fuel is insufficient to cool the tip of the nozzle. For example, when the injector is used for pilot injection, pre-injection, and/or through the use of a second injector, the mode of providing for heat transfer between the lower part of the nozzle outer body and the injection fluid is limited. Consequently, heat deformation of the nozzle tip and fuel coking, a condition created by fuel being exposed to reducing conditions, i.e., oxygen conditions which lead to carbon buildup, can occur as a direct result of insufficient cooling.

Moreover, with the advent of increased emissions regulations, alternative fuels and blends thereof have been pursued to provide alternative combustible fuels that may be used in various internal combustion engines such as modified diesel engines. However, such alternative fuels have different burn temperatures and characteristics, and certain fuels such as natural gas has a tendency to burn with a combustion flame which is positioned closer to the tip of the nozzle thereby exposing the tip of the nozzle to much higher temperatures than those experienced during normal diesel fuel combustion.

There have been various devices and methods proposed for reducing the temperature of the tip of the nozzle tip during operation of the internal combustion engine. For example, Australian Patent No. 204195 discloses an injector including a joint tightening cone with a central opening to receive the nozzle housing therethrough. The tightening cone is made of a different material than that of the nozzle and one which has good heat conduction, such as aluminum or copper. During operation of the internal combustion engine, the cone expands to tightly contact the nozzle shank of the nozzle housing thereby preventing heating of the nozzle tip that may be caused by entrance of combustion gases at the interface of the cone and the nozzle shank. The reference further discloses that favorable heat transmission conditions from the nozzle tip to the cooled cylinder head are provided via the cone. One disadvantage of such a design is that it requires a cone having a material composition different than the rest of the injector, which may increase manufacturing costs and further complicate the operation of the injector due to the differing expansion and contraction characteristics of the cone as compared to various other components of the injector.

In another approach, U.S. Pat. No. 5,860,394 discloses an injector having a nozzle tip which has an approximately 45° angle tapered nozzle tip surface which abuts a heat insulator that reduces the heat conducted from the cylinder head to the injector tip and further serves as a seal against the coolant flowing around the injector. The disadvantage of this design is that it is highly sensitive to manufacturing tolerance variances and is susceptible to failure due to the reduced material thickness of the cylinder head caused by the coolant passage that must flow very close to the nozzle tip.

U.S. Pat. No. 5,765,755 assigned to the assignee of the present invention, Cummins Engine Co., and which is hereby incorporated by reference, discloses a rate shaping nozzle assembly having an electro-discharge machined (EDM) spill passage, wherein fuel is purged from the spill passage between each injection event. Some cooling of the nozzle body will occur due to the purging of the fuel to drain. However, drainage occurs at the tip of the nozzle housing limiting the cooling effect of the fuel flowing to drain.

Therefore, there exists an unfulfilled need for an improved fuel injector having a practical and cost effective manner for increasing heat transfer from the lower nozzle body of a high pressure common rail injector. In particular, there exists an unfulfilled need for such a nozzle that will dissipate heat at a fast enough rate allowing the use of current material to form the nozzle body without adverse thermal effects to the material, thus avoiding more expensive heat resistant materials. In this regard, there is an unfulfilled need for such a nozzle which avoids expensive tooling and set-up charges by enabling the use of existing nozzles without the disadvantages of the prior art designs, especially when the fuel injector is used to deliver diesel pilot injections and/or used with alternative fuels, such as natural gas.

SUMMARY OF THE INVENTION

In view of the foregoing, it is an object of the present invention to provide a common rail needle control injector having improved cooling of the lower nozzle.

Another object of the present invention is to provide improved cooling of a fuel injector nozzle by increasing the nozzle body surface area in contact with the fuel to increase heat dissipation.

Still another object of the present invention is to provide a fuel injector utilizing current nozzle bodies capable of dissipating heat from the lower nozzle housing at a faster rate thereby avoiding the need for expensive heat resistant materials.

In accordance with these and other objects of the present invention there is provided a fuel injector for injecting pressurized fuel into a combustion chamber of an internal combustion engine, the injector comprising a nozzle housing including a nozzle bore extending along a longitudinal axis thereof. A nozzle valve element is disposed within the nozzle bore. The nozzle valve element has a longitudinal passage extending along a length of the nozzle valve element and includes an outer end for discharging a flow of cooling fluid and an inner end for receiving a flow of cooling fluid. The nozzle valve element further includes at least one transverse passage located adjacent the inner end of the longitudinal passage and extends transversely between the longitudinal passage and the nozzle bore. A quantity of cooling medium flows into the nozzle bore, through the transverse passage into the longitudinal passage and along the longitudinal passage to cool the nozzle valve element.

In accordance with another preferred embodiment of the present invention there is provided a fuel injector having a cooled nozzle body comprising a nozzle housing having an outer peripheral surface. The nozzle housing includes a nozzle cavity and a nozzle valve element disposed within the nozzle cavity. An annular passage is in communication with the nozzle cavity and a drain formed in the nozzle body. Orifice means connect the nozzle cavity and the annular passage. A quantity of cooling medium flows into the nozzle cavity through the orifice means and through the annular passage to drain thereby cooling the nozzle valve element.

These and other objects, features and advantages of the present invention will become more apparent from the following detailed description of the invention when viewed in conjunction with the accompanying drawings.

DETAILED DESCRIPTION OF THE PREFERRED EMBODIMENTS

Figure 1:
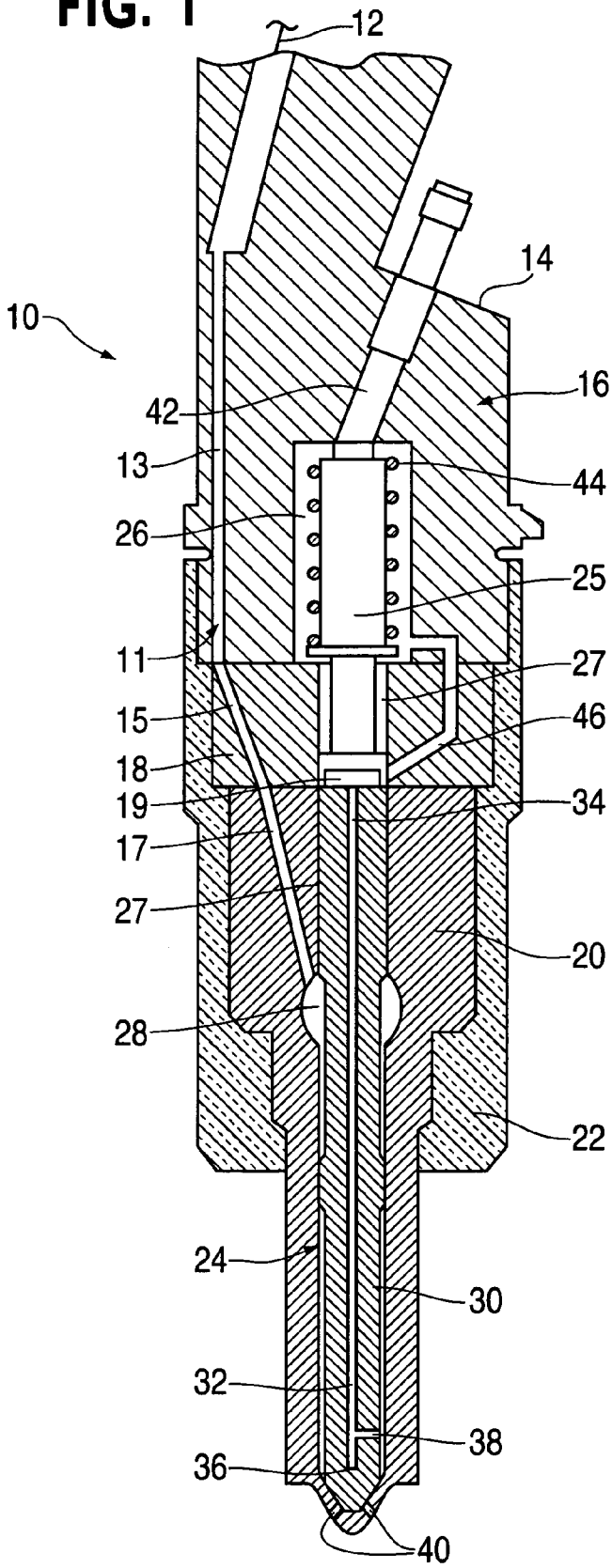
FIG. 1 is common rail needle controlled fuel injector having a lower nozzle body with improved cooling in accordance with one embodiment of the present invention.
Figure 2:
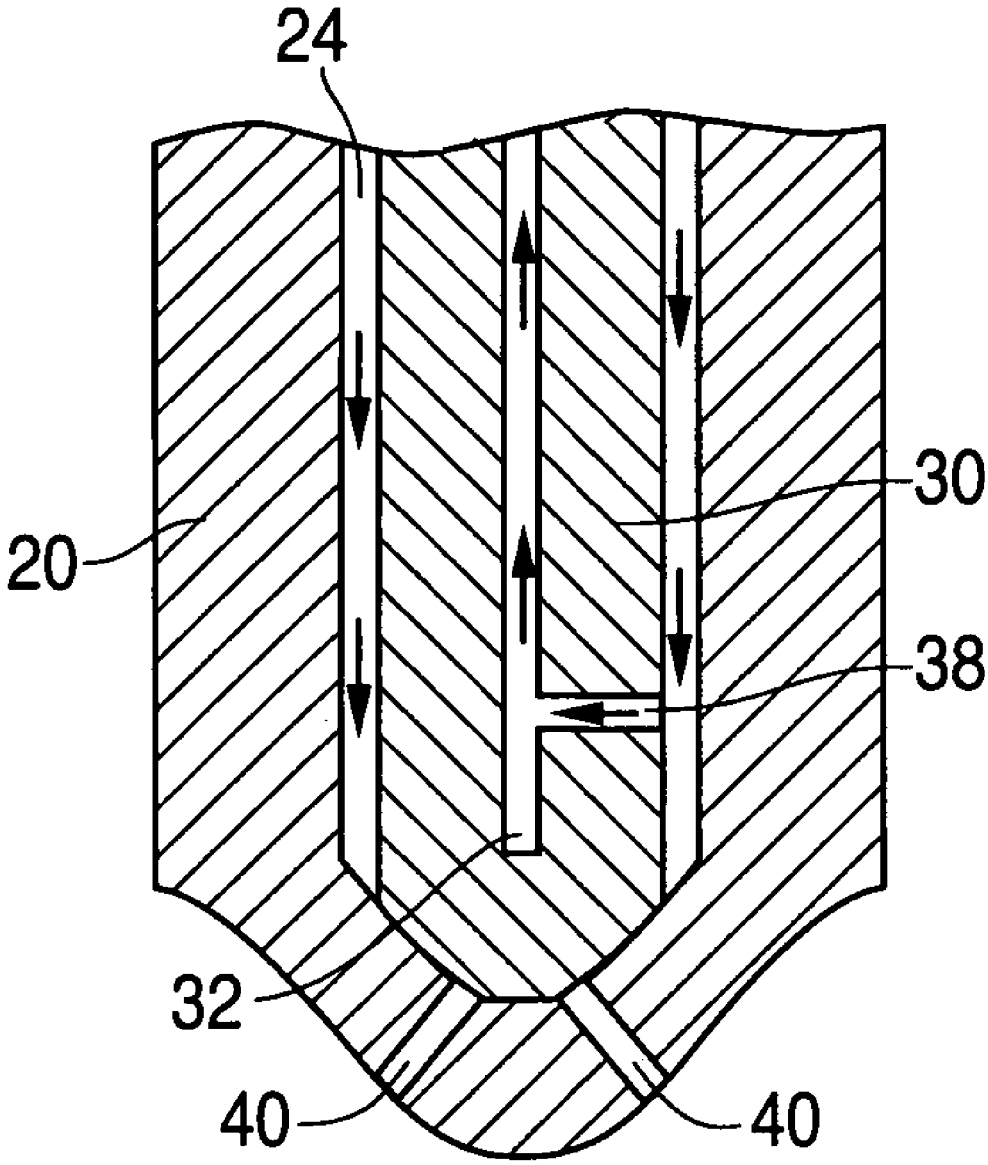
FIG. 2 is an enlarged cross-sectional view of the nozzle of the fuel injector of FIG. 1.

Referring to FIGS. 1 and 2, there is shown a first embodiment of a common rail needle controlled injector having improved lower nozzle body cooling. Referring to FIG. 1, there is shown a fuel injector 10 designed to receive high pressure fuel from a delivery line of a high pressure source (not shown). The high pressure source or system delivering the high pressure fuel to the injector may be a pump-line-nozzle system including one or more high pressure pumps and/or a high pressure accumulator and/or a fuel distributor. Injector 10 generally includes an injector body 14 formed from an outer barrel 16, an inner barrel 18, a nozzle housing 20 and a retainer 22. The inner barrel 18 and nozzle housing 20 are held in a compressive buffing relationship in the interior of retainer 22 by outer barrel 16. The outer end of retainer 22 contains internal threads for engaging corresponding external threads on the lower end of outer barrel 16 to permit the entire injector body 14 to be held together by simple relative rotation of retainer 22 with respect to outer barrel 16.

As is well known, injector body 14 includes an injector cavity indicated generally at 24 which includes a spring cavity 26 formed in outer barrel 16, a nozzle valve element bore 27 formed in the inner barrel 18 and nozzle housing 20, and a nozzle cavity 28 formed in the lower end of nozzle housing 20. The injector body 14 includes a fuel transfer circuit 11 comprised of a delivery passage 13 formed in body 14, and transfer passages 15 and 17 formed in inner barrel 18 and nozzle housing 20 respectively, for delivering fuel from a delivery line 12 to nozzle cavity 28. Injector body 14 also includes one or more injector orifices 40 fluidically connecting nozzle cavity 28 with a combustion chamber of an engine (not shown).

Fuel injector 10 also includes a nozzle valve element 30 slidably received in bore 24 and extending into nozzle cavity 28. A biasing spring 44 positioned in spring cavity 26 abuts a spring piston 25 so as to bias the inner end of nozzle valve element 30 into a closed position, i.e., the nozzle valve element contacts the valve seat, blocking fuel flow through injector spray holes or orifices 40. The inner end of spring piston 25 abuts nozzle valve element 30 and includes one or more transverse openings 19. Injector body 14 also includes a low pressure drain circuit including spring cavity 26 and a drain passage 42. Any fuel leaking through the slight clearance between nozzle valve element 30 and bore 24 will be directed to a low pressure drain via cavity 26 and drain passage 42.

The nozzle assembly of the present invention as described hereinabove can be adapted for use with a variety of injectors and, therefore, is not limited to the injector disclosed in FIG. 1. Therefore, a further description is not required to understand or practice the present invention and should not be construed to limit the scope of the present. Also, it should be appreciated by one having ordinary skill in the art that only certain components of the fuel injector have been illustrated. In this regard, it should also be noted that the present invention may be applied to fuel injectors and fuel systems of various designs. The fuel injector may be any type of fuel injector having a nozzle valve to control the delivery of high pressure fuel to a combustion chamber. For example, injector 10 may receive high pressure fuel from a high pressure common rail or, alternatively, a dedicated pump assembly, such as in a pump-line-nozzle system or a unit injector system incorporating, for example, a mechanically actuated plunger into the injector body. Likewise, the injector may include a servo-controlled needle with an actuator controlled valve for controlling the drain of high pressure fuel from a control chamber to cause opening and closing of the needle valve element such as disclosed in U.S. Pat. No. 6,499,467, the entire contents of which is herein incorporated by reference. The injector may alternatively include a conventional spring-biased needle valve as shown in U.S. Pat. No. 5,647,536, the entire content of which is herein incorporated by reference.

Referring to FIGS. 1 and 2, the cooling circuit of the present invention includes a blind passage 32 which is electro-discharge machined (EDM) into the nozzle valve element 30. Blind passage 32 extends approximately 90% of the length of nozzle valve element 30 to form a blind end 36 terminating within nozzle valve element 30 and has a diameter approximately 2.5 times the diameter of one spray hole 40. Blind passage 32 is formed from the upper portion of the nozzle valve element 30 and extends axially along the longitudinal axis thereof toward the inner end of the nozzle valve element 30. The passage 32 is sized such that heat transfer along its length will maintain a recommended temperature at the injector tip of about 240–572° F. Typically the diameter of each spray hole 40 is of about 0.1 mm to 1 mm, depending upon the amount of energy loss that is tolerable.

Blind passage 32 connects with bore 24 via a transverse passage 38. Transverse passage 38 is sized to function as a metering orifice. An outer end 34 of blind passage 32 communicates with drain passage 42 via transverse openings 19, nozzle valve element bore 27 and spring cavity 26. An inner end portion of blind passage 32 connects with the rail pressure through passage 38 to cause a small metered amount of cooling medium (fuel) to flow through the nozzle. To control the amount of fuel for cooling and minimize losses, the diameter of passage 38 should be approximately equal to the diameter of a spray hole of the injector.

As shown by the arrows in FIG. 2, during cooling the fuel that normally exists in the bore 24 about the tip of the needle is routed through transverse passage 38 and into blind passage 32 through the nozzle valve element to drain passage 42 throughout operation. Thus, sufficient inward cooling occurs by providing more surface area over which the fuel flows. Instead of, or in addition to, relying on bore 27 to direct cooling fuel to cavity 26, a drain path 46 may be formed in injector body 14.

The diameters of blind passage 32 and transverse passage 38 are sized to maximize heat transfer, i.e., to provide the desired flow. Passage 38 is sized to achieve the desired cooling depending on the particular application in the injector, i.e. it is a controlling and metering orifice. Thus, if it is too large it will adversely affect injection when nozzle valve element 30 is open and adversely increase parasitic losses when nozzle valve element 30 is closed.

Due to the substantial length that blind passage 32 extends through the nozzle valve element 30, the cooling fuel passes through a greater portion of the nozzle valve element than the prior art cooling circuits, approximately a 30% increase in surface area is provided by the cooling circuit arrangement of the present invention. Moreover, heat dissipates at a faster rate due to the substantial length of passage 32 in relation to the length of the needle.

Figure 3:
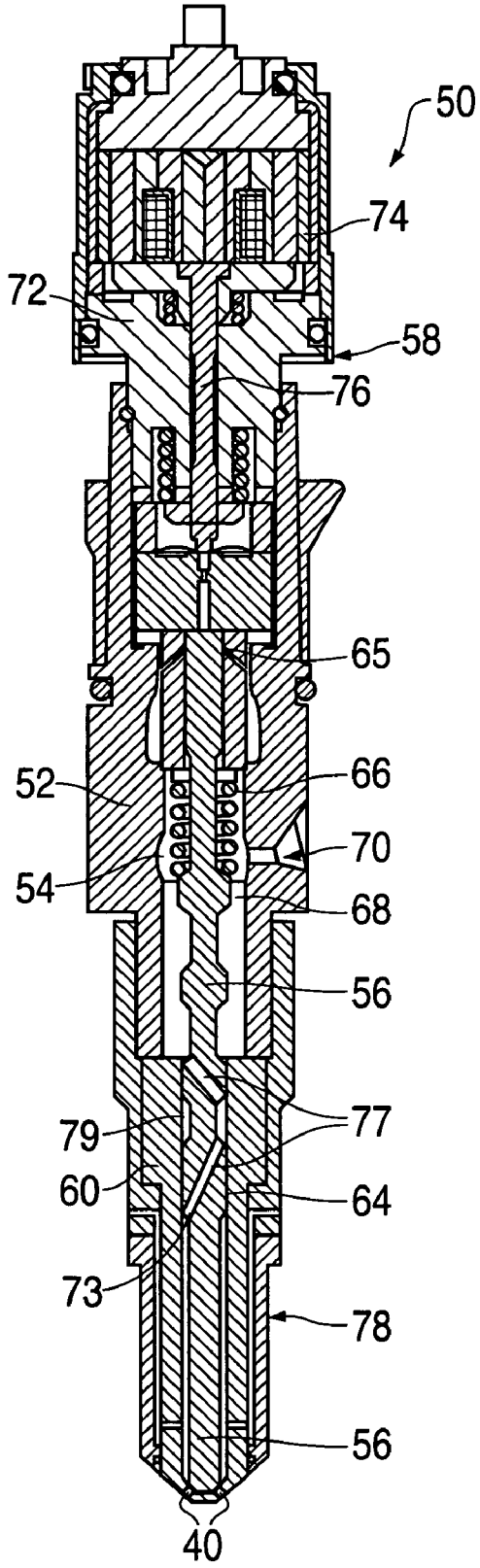
FIG. 3 is a cross-sectional view of a common rail needle controlled fuel injector having a lower nozzle body with improved cooling in accordance with another embodiment of the present invention.
Figure 4:
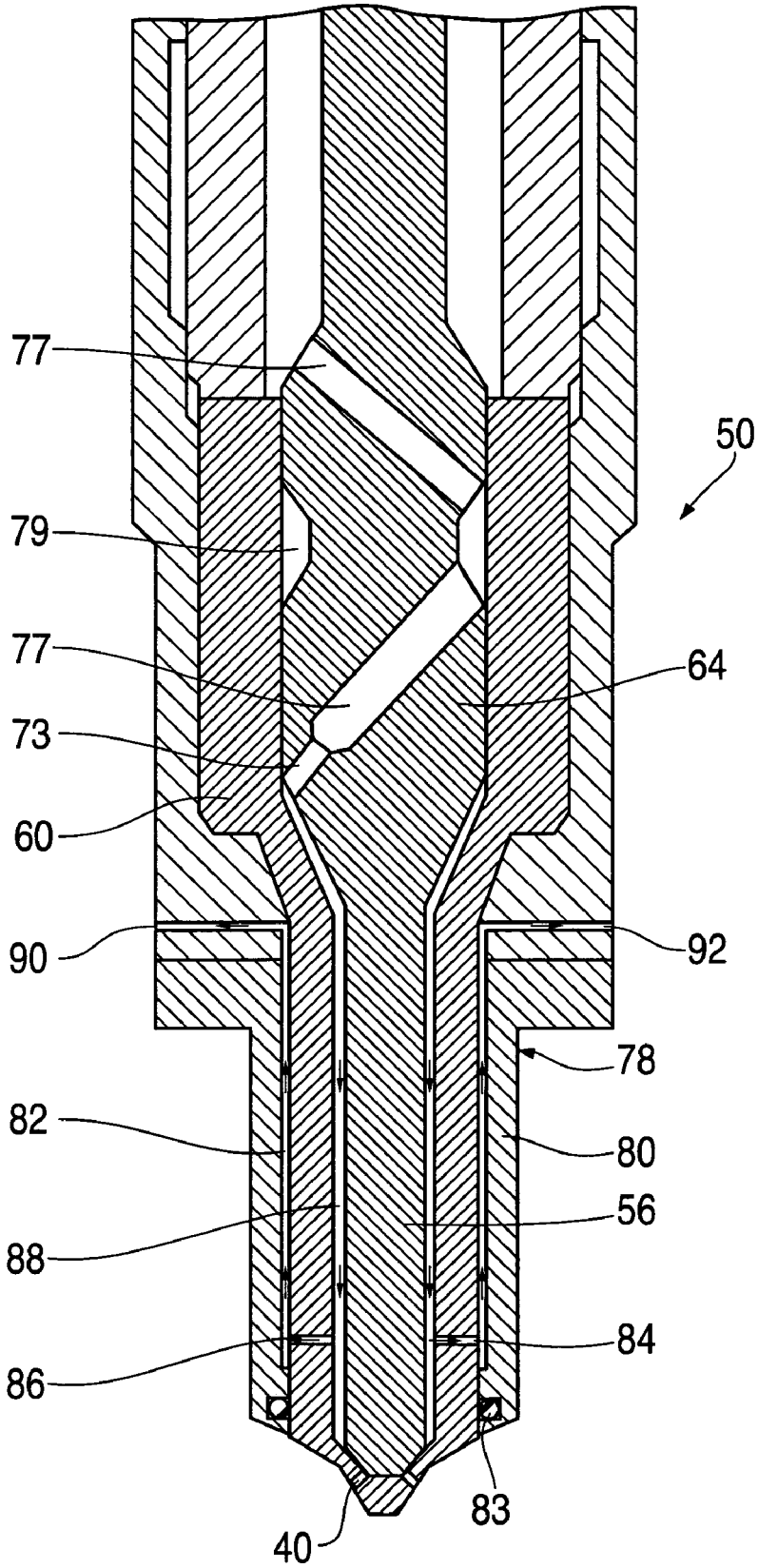
FIG. 4 is an enlarged cross-sectional view of the nozzle of the fuel injector of FIG. 3.

FIGS. 3 and 4 illustrate another embodiment of the present invention for cooling a fuel injector 50 having a pressurized spring cavity, for example, such as disclosed in U.S. Pat. No. 6,499,467, the entire contents of which is hereby incorporated by reference. Injector 50 generally includes an injector body 52 containing an injector cavity 54, a nozzle valve element 56 mounted for reciprocal movement in injector cavity 54, a nozzle valve actuating system 58 and a nozzle housing 60.

Nozzle valve element 56 includes an inner guide portion 64 sized to form a close sliding fit with the inside surface of fuel injector cavity 54 creating a fluid seal which substantially prevents fluid from leaking from the clearance between the outer surface of inner guide portion 64 and the opposing surface of injector body 52 forming injector cavity 54.

Nozzle valve element 56 is biased into the closed position by a bias spring 66 positioned in a spring chamber 68 formed between outer guide portion 65 and inner guide portion 64. A fuel transfer circuit 70 also delivers supply fuel to spring chamber 68 for delivery to injector orifices 40 when nozzle valve element 56 is in an open position.

Nozzle valve actuating system 58 includes an injection control valve 72 having a control valve member 76 and an actuator assembly 74 for selectively moving control valve member 76. It should be noted that actuator assembly 74 may be any type of actuator assembly capable of selectively and quickly controlling the movement of control valve member 76. For example, actuator assembly may be of the electromagnetic, magnetorestrictive or piezoelectric type.

A transfer circuit is provided in the form of two transverse passages 77 connected by an annular groove 79, all formed in nozzle valve element 56. An inner restriction orifice 73 is formed in the inner transfer passage 77 extending through inner guide portion 64 of nozzle valve element 56.

FIG. 4 is an enlarged cross-section of the lower portion of injector 50 of FIG. 3. Injector 50 includes a closed nozzle assembly 78. Nozzle assembly 78 includes nozzle housing 60 and nozzle valve element 56 disposed in a nozzle cavity 88 in housing 60. A sleeve 80 is disposed around the lower portion of nozzle housing 60 to form an annular passage 82. Sleeve 80 is formed to fit over the existing nozzle and can be a separate component fitted to the outer diameter of nozzle housing 60 by a seal 83. Seal 83 can be made of Torlon® or another suitable seal material.

Passage 82 is connected with a drain into which fuel may be metered via a pair of orifices 84 and 86 located at the lower end thereof. Orifices 84, 86 have a diameter equal to the size of one of the spray holes. As shown in FIG. 4, orifices 84, 86 connect nozzle cavity 88 with annular passage 82. In this regard, as shown by the arrows in FIG. 4, the high pressure cooling medium (fuel) in cavity 88 is redirected through orifices 84, 86 to passage 82. Thereafter, the fuel travels upward through annular passage 82 along the length of lower housing 60 and to drain ports 90, 92 located in nozzle assembly 78. Thus, the cooling medium contacts the nozzle body as it moves upward along the entire lower portion thereof, increasing heat dissipation.

Alternatively, sleeve 80 could be formed as an integral part of the nozzle housing or a nozzle retainer. If the sleeve is made as an integral part of the nozzle housing, passages for the cooling medium can be made therein by EDM, as in the first embodiment of the present invention.

As previously set forth hereinabove, hot combustion gases can enter the prior art nozzles along the outer peripheral surface of the nozzle shank thereby increasing the temperature of the nozzle and the fuel injector. As described previously, such hot combustion gases were not a significant problem in conventional diesel fuel injector applications since during normal operation of the diesel engine, a sufficient quantity of fuel was injected so that the injected fuel functioned as a cooling medium to cool the nozzle. However, in fuel injector applications where the fuel injector is used to provide low volume pilot injections or for injecting alternative fuels, the present applicants found that such hot gases can detrimentally impact the performance of the prior art fuel injector or even damage the prior art nozzle. Thus, the embodiments of the present invention eliminate this prior art problem by directing a flow of cooling fluid (fuel)

through the nozzle valve element throughout operation and, preferably, using a blind cooling passage extending a substantial length through the nozzle valve element, i.e. extending approximately 90% of the length of nozzle valve element.

Furthermore, improved cooling is attained at minimal cost since the nozzle components may be made of the current nozzle materials, i.e., having a $HR_c$=45, and need not be made of the more expensive heat resistant materials having higher thermal expansion coefficients.

From the foregoing, it should now be apparent to a person of ordinary skill in the art how the present invention provides improved cooling of the lower body of a common fuel injector. It should also be evident that nozzles incorporating the features of the present invention have increased reliability and performance which is the resultant of the improved cooling. Consequently, the present invention minimizes the problems associated with high nozzle temperatures present in prior art fuel injectors, especially when injectors are used for pilot injections or alternative fuels are used.

While various embodiments in accordance with the present invention have been shown and described, it is understood that the present invention is not limited thereto. The present invention may be changed, modified and further applied by those skilled in the art. Therefore, this invention is not limited to the detail shown and described previously, but also includes all such changes and modifications.

What is claimed is:

1. A fuel injector for injecting pressurized fuel into a combustion chamber of an internal combustion engine, the injector comprising:

a nozzle housing including a nozzle bore extending along a longitudinal axis thereof;

a nozzle valve element disposed within said nozzle bore;

a longitudinal passage extending substantially parallel to said nozzle valve element, said longitudinal passage including an outer end for discharging a flow of cooling fluid and an inner end for receiving a flow of cooling fluid;

at least one transverse passage located adjacent said inner end of said longitudinal passage and extending transversely between said longitudinal passage and said nozzle bore; and a sleeve disposed around said nozzle housing that at least partially defines said longitudinal passage;

wherein a quantity of cooling medium flows into the nozzle bore, through said transverse passage, into said longitudinal passage, and along said longitudinal passage at least when said nozzle valve element is in a closed position within said nozzle bore to cool said nozzle valve element.

2. The fuel injector of claim 1, wherein said longitudinal passage extends along approximately 90% of the length of said nozzle valve element.

3. The fuel injector of claim 1, wherein said cooling medium is the injection fuel delivered to the fuel injector.

4. The fuel injector of claim 1, further including a seal adapted to prevent leakage of said cooling fluid from said longitudinal passage into the combustion chamber.

5. The fuel injector of claim 4, wherein said seal is positioned between said nozzle housing and said sleeve.

6. The fuel injector of claim 1, wherein said nozzle housing includes at least one injector orifice, said cooling medium flowing in said longitudinal passage in a direction away from said at least one injector orifice.

7. The fuel injector of claim 1, wherein said inner end of the longitudinal passage terminates at a blind end.

8. The fuel injector of claim 1, wherein said longitudinal passage extends along approximately 90% of the length of said nozzle valve element.

9. The fuel injector of claim 1, wherein said outer end opens at an end face of the nozzle valve element.

10. A fuel injector for injecting pressurized fuel into a combustion chamber of an internal combustion engine, the injector comprising:

a nozzle housing including a nozzle bore extending along a longitudinal axis thereof; and a nozzle valve element disposed within said nozzle bore, said nozzle valve element having a longitudinal passage extending along a length of said nozzle valve element, said longitudinal passage including an outer end for discharging a flow of cooling fluid and an inner end for receiving a flow of cooling fluid, said nozzle valve element further including at least one transverse passage located adjacent said inner end of said longitudinal passage and extending transversely between said longitudinal passage and said nozzle bore, wherein a quantity of cooling medium flows into the nozzle bore, through said transverse passage, into said longitudinal passage, and along said longitudinal passage at least when said nozzle valve element is in a closed position within said nozzle bore to cool said nozzle valve element;

wherein said nozzle housing includes at least one spray hole and said longitudinal passage has a diameter which is approximately 2.5 times a diameter of the at least one spray hole.

11. A fuel injector for injecting pressurized fuel into a combustion chamber of an internal combustion engine, the injector comprising:

a nozzle housing including a nozzle bore extending along a longitudinal axis thereof; and a nozzle valve element disposed within said nozzle bore, said nozzle valve element having a longitudinal passage extending along a length of said nozzle valve element, said longitudinal passage including an outer end for discharging a flow of cooling fluid and an inner end for receiving a flow of cooling fluid, said nozzle valve element further including at least one transverse passage located adjacent said inner end of said longitudinal passage and extending transversely between said longitudinal passage and said nozzle bore, wherein a quantity of cooling medium flows into the nozzle bore, through said transverse passage, into said longitudinal passage, and along said longitudinal passage at least when said nozzle valve element is in a closed position within said nozzle bore to cool said nozzle valve element;

wherein said nozzle housing includes at least one spray hole and said transverse passage has a diameter approximately equal to the diameter of the at least one spray hole.

12. A fuel injector, comprising:

a nozzle housing having an outer peripheral surface and a nozzle cavity;

a nozzle valve element disposed within said nozzle cavity;

an annular passage surrounding said nozzle housing adjacent said outer peripheral surface, said annular passage in communication with said nozzle cavity and a drain;

orifice means formed in said nozzle housing for connecting said nozzle cavity and said annular passage to provide a flow of cooling medium from the nozzle cavity through the orifice means, into said annular passage, for delivery to drain at least when said nozzle valve element is in a closed position within said nozzle cavity, thereby cooling said nozzle valve element; and a seal adapted to prevent leakage of said cooling fluid from said annular passage into the combustion chamber.

13. The fuel injector of claim 12, wherein said orifice means comprises at least one orifice disposed within said nozzle housing and connecting said nozzle cavity and said annular passage.

14. The fuel injector of claim 12, wherein said cooling medium is fuel delivered to the fuel injector.

15. The fuel injector of claim 12, wherein said nozzle housing includes at least one injector orifice, said cooling medium flowing in said annular passage in a direction away from said at least one injector orifice.

16. The fuel injector of claim 12, wherein said annular passage is at least partially defined by a sleeve.

17. The fuel injector of claim 16, wherein said seal is positioned between said nozzle housing and said sleeve.

18. A fuel injector, comprising;

a nozzle housing having an outer peripheral surface and a nozzle cavity;

a nozzle valve element disposed within said nozzle cavity:

an annular passage surrounding said nozzle housing adjacent said outer peripheral surface, said annular passage in communication with said nozzle cavity and a drain;

orifice means formed in said nozzle housing for connecting said nozzle cavity and said annular passage to provide a flow of cooling medium from the nozzle cavity, through the orifice means, into said annular passage, for delivery to drain at least when said nozzle valve element is in a closed position within said nozzle cavity, thereby cooling said nozzle valve element; and a sleeve disposed over said nozzle housing, said annular passage being formed between said sleeve and nozzle housing.

19. The fuel injector of claim 18, wherein said annular passage extends along approximately the entire length of said sleeve.

20. The fuel injector of claim 18, wherein said nozzle housing includes at least one injector orifice, said cooling medium flowing in said annular passage in a direction away from said at least one injector orifice.

21. The fuel injector of claim 18, further including a seal between said sleeve and said nozzle housing.

22. A fuel injector, comprising:

a nozzle housing having an outer peripheral surface and a nozzle cavity;

a nozzle valve element disposed within said nozzle cavity;

an annular passage surrounding said nozzle housing adjacent said outer peripheral surface, said annular passage in communication with said nozzle cavity and a drain; and orifice means formed in said nozzle housing for connecting said nozzle cavity and said annular passage to provide a flow of cooling medium from the nozzle cavity through the orifice means, into said annular passage, for delivery to drain at least when said nozzle valve element is in a closed position within said nozzle cavity, thereby cooling said nozzle valve element;

wherein said orifice means comprises at least one orifice disposed within said nozzle housing and connecting said nozzle cavity and said annular passage, said nozzle housing including at least one spray hole, and said at least one orifice has a diameter approximately equal to the diameter of the at least one spray hole.

* * * * *